US006153314A

United States Patent [19]

Gilles et al.

[11] Patent Number: 6,153,314

[45] Date of Patent: Nov. 28, 2000

[54] HOT-DIP GALVANIZING BATH AND PROCESS

[75] Inventors: Michael Gilles, Geel, Belgium; Richard Sokolowski, Raches, France

[73] Assignee: N. V. Union Miniere S.A., Brussels, Belgium

[21] Appl. No.: 09/125,682

[22] PCT Filed: Feb. 20, 1997

[86] PCT No.: PCT/EP97/00864

§ 371 Date: Dec. 9, 1998

§ 102(e) Date: Dec. 9, 1998

[87] PCT Pub. No.: WO97/31137

PCT Pub. Date: Aug. 28, 1997

[30] Foreign Application Priority Data

Feb. 23, 1996 [EP] European Pat. Off. ..... 96200465

[51] Int. Cl.[7] ..... B32B 15/18; B05D 1/18; C23C 2/06

[52] U.S. Cl. ..... 428/659; 427/433; 427/436; 428/681; 106/1.05; 106/1.17

[58] Field of Search ..... 427/433, 436; 106/1.17, 1.05; 428/681, 659

[56] References Cited

U.S. PATENT DOCUMENTS 3,962,501 6/1976 Ohbu et al. ..... 427/433
4,439,397 3/1984 Dreulle ..... 420/519
4,451,541 5/1984 Beal ..... 428/658
5,049,453 9/1991 Suemitsu et al. ..... 428/629
5,455,122 10/1995 Carey et al. ..... 428/659

OTHER PUBLICATIONS

C.H. Mathewson, *Zinc, The Science and Technology of the Metal, Its Alloys and Compounds* (1959).

Kirk–Othmer, *Encyclopedia of Chemcial Terminology*, vol. 24, p. 833 (1984).

*Zinc de deuxieme fusion* (NF A 55–111), ICS: 77.120.60 (Jun. 1995).

*Primary Examiner*—Shrive Beck
*Assistant Examiner*—Michael Barr
*Attorney, Agent, or Firm*—Jones Jain, L.L.P.; Chittaranjan N. Nirmel; Mishrilal Jain

[57] ABSTRACT

A zinc bath, which is particularly useful for batch-wise galvanizing of steel articles, of which the silicon content is not certain, contains 1–5 wt % of tin, 0.01–0.1 wt % of nickel, lead at a concentration up to saturation, and at least one of aluminum, calcium and magnesium, with the rest being zinc of any quality going from remelted scrap to SHG zinc.

13 Claims, 4 Drawing Sheets

HOT-DIP GALVANIZING BATH AND PROCESS

FIELD OF THE INVENTION

The present invention relates to a bath for hot-dip galvanizing consisting of alloyed zinc, that is particularly useful for batch-wise galvanizing steel articles, the silicon content of which is variable or the composition of which is unknown.

BACKGROUND OF THE RELATED ART

When galvanizing steel in a conventional non-alloyed zinc bath, serious problems arise, when the steel contains more than 0.02 wt % of silicon: the resulting zinc coating is both too thick and too brittle and in addition it has a greyish aspect. This is due to the fact that the iron—zinc alloy layer, which forms on the surface of the steel when the latter is in contact with a conventional zinc bath, grows linearly with time during the entire duration of the immersion, when the steel contains more than 0.02 wt % of silicon. This is not the case with steels containing less silicon, as the growth rate is here proportional to the square root of the immersion time. The influence of the silicon content of the steel on the coating thickness is illustrated in FIG. 1, wherein the thickness peak on steels with 0.03–0.15 wt % Si is called the Sandelin peak.

Efforts have already been made in the past to cope with this problem. The Technigalva® process uses a zinc bath alloyed with 0.05–0.06 wt % of nickel. As shown in FIG. 1, the Sandelin peak disappears in the Technigalva® bath, but the coating thickness still increases with the silicon content of the steel. The Polygalva® process uses a zinc bath with 0.035–0.045 wt % of aluminium and 0.003–0.005 wt % of magnesium. As shown in FIG. 1, the Polygalva® bath gives rather good results; however it presents the drawback that its aluminium content has to be controlled very strictly, because the reaction between the steel and the bath blocks almost completely once the aluminium content of the bath exceeds 0.05 wt %.

SUMMARY OF THE INVENTION

The aim of the present invention is to provide a bath for hot-dip galvanizing consisting of alloyed zinc, which makes the coating thickness much less dependent on the silicon content of the steel than is the case with the Technigalva® bath and much less dependent on small variations in the bath composition than is the case with the Polygalva® bath.

This aim is achieved according to the invention by a bath that contains 1–5 wt % of tin and 0.01–0.1 wt % of nickel and that may contain lead at a concentration up to saturation and at least one of aluminium, calcium and magnesium at a concentration up to 0.06 wt %, the rest being zinc and unavoidable impurities.

When the bath does not contain nickel, its preferred tin content is 3.5–14 wt %, the most preferred tin content being 5–10 wt %. When it contains nickel, its preferred tin and nickel contents are respectively 2.5–5 wt % and 0.03–0.06 wt %.

The nickel content of the bath with 1–5 wt % of tin has to be at least 0.01 wt %; otherwise, the coating thickness may vary substantially with the silicon content of the steel. However, the nickel content mustn't exceed 0.1 wt %; otherwise there is a risk of formation of floating dross.

An addition of lead at a concentration that may attain saturation, for example 0.1–1.2 wt %, may be useful in order to decrease the surface tension of the bath.

An addition of at least one of aluminium, calcium and magnesium, preferably at a concentration of 0–0.03 wt % and more preferably of 0.005–0.015 wt %, may also be useful in order to protect the zinc from oxidation; otherwise a yellowish pellicle is formed on the surface of the bath, which fouls the galvanized articles.

However the aluminium content preferably should not exceed 0.03 wt %; otherwise there is a risk of obtaining uncovered spots. The magnesium and/or calcium contents mustn't exceed 0.03 wt %; otherwise MgO or CaO floating on the surface of the bath may spoil the coating; moreover the bath becomes less fluid, and may result in a degraded finishing of the coating.

It should be noted here that LU-A-81 061 describes a process consisting of a galvanisation bath which contains at least 70 wt % of zinc, characterized in that one or more of the following elements is added to said galvanization bath: chromium, nickel, boron, titanium, vanadium, zirconium, manganese, copper, niobium, cerium, molybdenum, cobalt, antimony, calcium, lithium, sodium, potassium, in such an amount that the bath contains less than 2 wt % of each element taken separately.

The zinc may be of any quality going from remelted zinc scrap to SHG (Special High Grade). It is however recommended to use at least Zn 98.5 (ISO standard 752-1981), preferably at least Zn 99.5 and still more preferably at least Zn 99.95.

The invention is illustrated by the following examples.

EXAMPLE 1

Six types of steel called X, M, E, D, R and Y with various silicon and phosphorus contents have been galvanized in baths of SHG zinc with various tin contents, using a bath temperature of 450° C. and an immersion time of 5 minutes.

The coating thickness has been measured.

The results of these tests are summarised in Table 1 hereafter.

TABLE 1

(Zn—Sn baths)

| Steel type | X | M | E | D | R | Y |
|---|---|---|---|---|---|---|
| wt % Si | 0.010 | 0.092 | 0.177 | 0.450 | 0.018 | 0.075 |
| wt % P | | | | | 0.069 | 0.017 |
| Sn content of bath | Coating thickness in μm | | | | | |
| 0.0 wt % | 63 | 244 | 136 | 236 | 398 | 271 |
| 1.0 wt % | 77 | 228 | | 189 | | |
| 2.5 wt % | 82 | 136 | 82 | 168 | 138 | 222 |
| 5.0 wt % | 78 | 100 | | 100 | | |
| 10.0 wt % | 91 | 86 | 67 | 84 | 98 | 81 |
| 20.0 wt % | 76 | 65 | 64 | 64 | 78 | 57 |
| 30.0 wt % | 59 | 58 | 54 | 61 | 67 | 52 |

Figure 1:
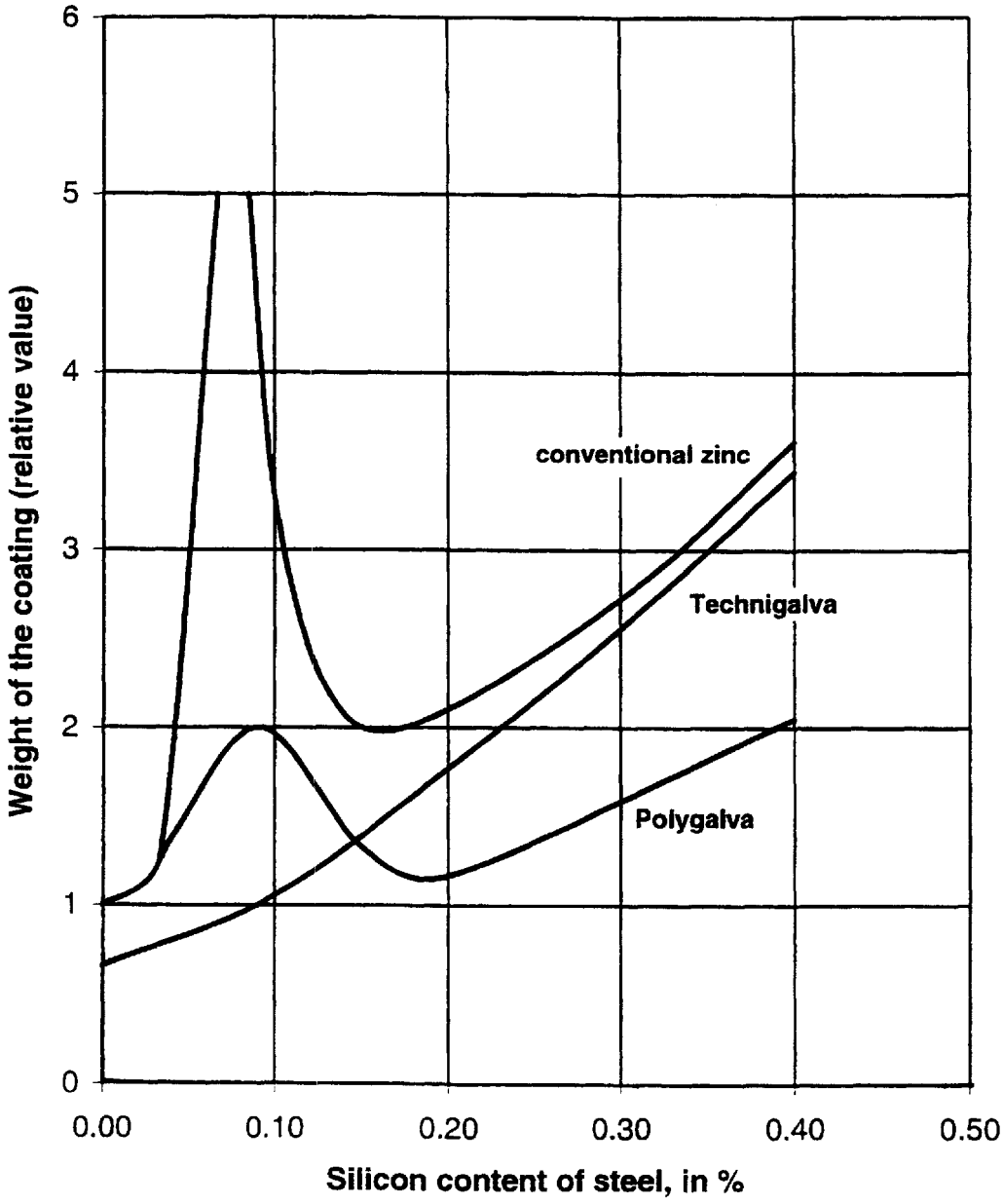
FIG. 1 is a plot of the weight of the coating (relative value) versus the silicon content of steel, in %, for three different hot-dip galvanizing processes.
Figure 2:
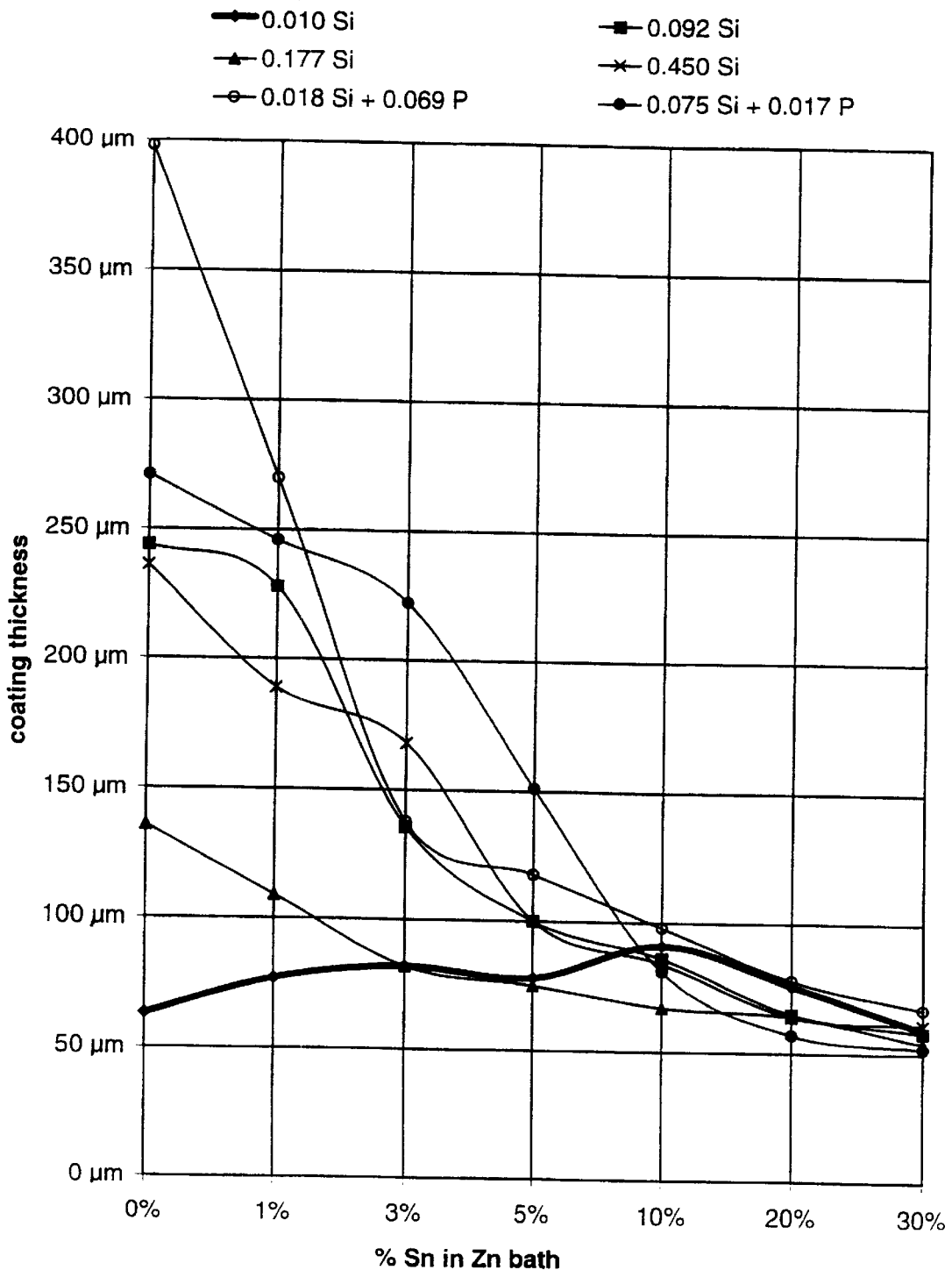
FIG. 2 is a plot of the coating thickness versus the % Sn in Zn bath, for steel articles having six different silicon and/or phosphorous contents.

The graphical representation of these results in the diagram of FIG. 2 shows that from a tin content of about 3 wt % on five of the six tested steels present already a coating thickness of less than 150 μm and that from a tin content of 5 wt % on all tested steels have a coating thickness ranging between about 75 μm and about 110 μm.

In this context it should be noted that a coating thickness of 70–90 μm is the most desirable one.

It should also be noted that steel type Y with 0.075 wt % Si and 0.017 wt % P is a particularly reactive one, the effect of P on the steel reactivity being still much more pronounced than that of Si.

From the above data it is also clear that the results do not improve when the tin content exceeds 15 wt % and that it is preferable to use no more than 10 wt % tin.

EXAMPLE 2

The same types of steel of Example 1 have been galvanized in baths of SHG zinc with 0.055 wt % nickel and various tin contents in the same conditions as in Example 1.

The results of these tests are summarised in Table 2 hereafter.

TABLE 2

(Zn - 0.055 Ni–Sn baths)

| Steel type | X | M | E | D | R | Y |
|---|---|---|---|---|---|---|
| Sn content of bath | Coating thickness in μm | | | | | |
| 0.0 wt % | 59 | 116 | 134 | 212 | 413 | 242 |
| 1.0 wt % | 67 | 97 | 92 | 195 | | |
| 2.5 wt % | 69 | 80 | 70 | 115 | | |
| 5.0 wt % | 72 | 80 | 72 | 95 | 88 | 88 |

Figure 3:
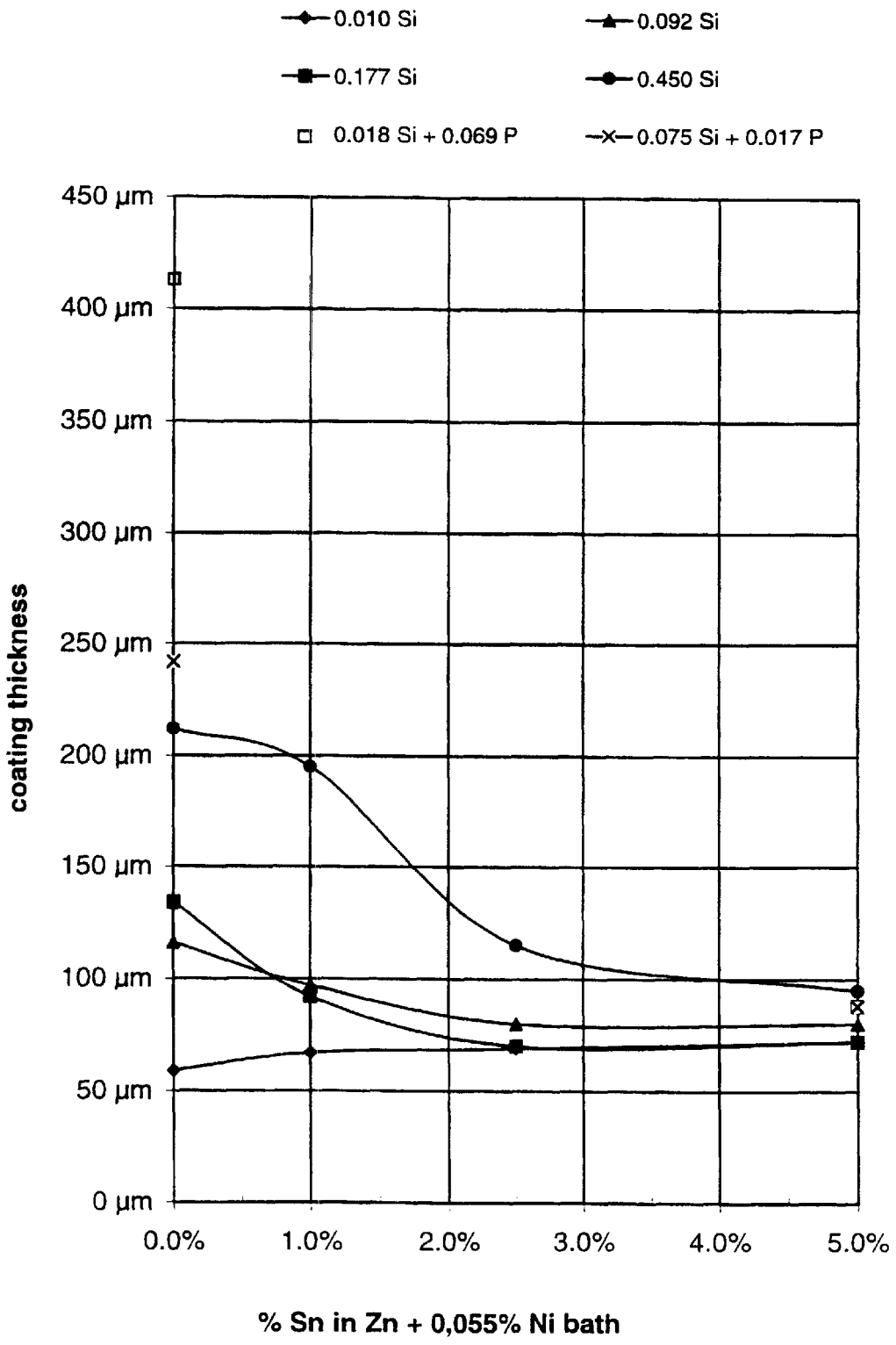
FIG. 3 is a plot of coating thickness versus % Sn in Zn containing 0.055% Ni in the galvanizing bath, for steel articles having six different Si and/or phosphorous contents.

The graphical representation of these results in the diagram of FIG. 3 shows that a tin content of 1 wt % a significant improvement. It also shows that it is preferable to use a tin content ranging between 2.5 and 5 wt %.

EXAMPLE 3

The same types of steel of Example 1 have been galvanized in baths of SHG zinc with 1.2 wt % lead and various tin contents in the same conditions as in Example 1.

The results of these tests are summarised in Table 3 hereafter.

TABLE 3

(Zn - 1.2 Pb–Sn baths)

| Steel type | X | M | E | D | R | Y |
|---|---|---|---|---|---|---|
| Sn content of bath | Coating thickness in μm | | | | | |
| 1.0 wt % | 79 | 219 | | 199 | | |
| 1.5 wt % | | | | 192 | | |
| 2.0 wt % | | | | 174 | | |
| 2.5 wt % | | | | 155 | | |
| 3.0 wt % | 82 | 109 | 88 | 138 | 123 | 128 |

Figure 4:
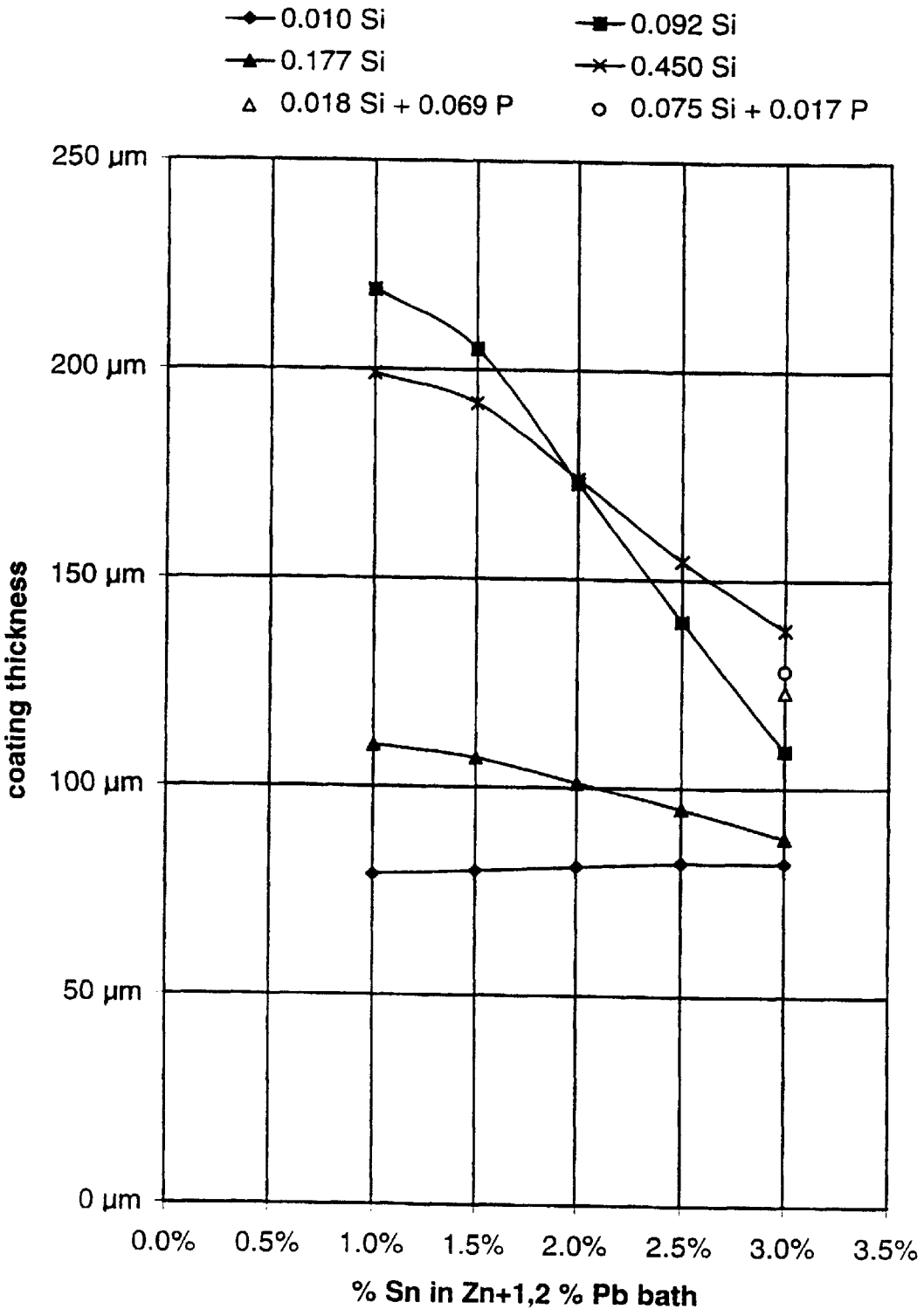
FIG. 4 is a plot of coating thickness versus % Sn in Zn containing 1.2% Pb in the galvanizing bath, for steel articles having six different Si and/or phosphorous contents.

The graphical representation of these results in the diagram of FIG. 4 shows again the beneficial effect of tin on the coating thickness.

The results achieved with 3 wt % tin are apparently somewhat better here than in Example 1 (see FIG. 2. Accordingly it may be useful to add lead to the bath.

The foregoing makes clear that the bath according to the present invention avoids the drawback of the Technigalva® bath and the drawback of the Polygalva® bath.

Another advantage of the bath of the present invention lies in the fact that it gives a nicer floral pattern and higher brightness than the prior art baths.

Noteworthy is also that in long run tests with the bath of present invention neither the formation of bottom dross nor the formation of floating dross has been observed.

Also important aspect is that the tin consumption is limited, the tin content of the coating being much lower than the tin content of the bath.

For these reasons the bath of the present invention is particularly useful for the toll galvanizing process, wherein the galvanizer has to treat all kinds of steel articles the silicon and phosphorus contents of which are usually unknown.

The invention presented herein is limited solely by the claims appended below. Persons of ordinary skill in the related art are expected to consider variations thereof within the scope of the disclosure, and all such variations are intended to be comprehended within the claimed invention.

What is claimed is:

1. A bath for hot-dip galvanizing with alloyed zinc, characterized in that it contains 1–5 wt % of tin, 0.01–0.1 wt % of nickel, lead at a concentration up to saturation and 0–0.06 wt % of at least one of aluminiuim, calcium and magnesium, the rest being zinc of any quality going from remelted zinc scrap to SHG zinc.

2. A bath according to claim 1, characterized in that it contains 0–0.03 wt % of at least one of aluminium, calcium and magnesium.

3. A bath according to claims 1 or 2, characterized in that it contains at least 2.5 wt % of tin.

4. A bath according to claims 1 or 2, characterized in that it contains at least 0.03 wt % of nickel.

5. A bath according to claim 4, characterized in that it contains 0.03–0.06 wt % of nickel.

6. A bath according to claim 2, characterized in that it contains 0.005–0.015 wt % of at least one of aluminium, calcium and magnesium.

7. A process for batch-wise hot-dip galvanizing of steel items in an alloyed zinc bath, the bath being characterized in that it contains:

1–5 wt % of tin, 0.01–0.1 wt % of nickel, lead at a concentration up to saturation, and 0–0.06 wt % of at least one of aluminum, calcium and magnesium, with the rest being zinc of any quality going from remelted scrap to SHG zinc.

8. A process according to claim 7, characterized in that the bath contains:

0–0.03 wt % of at least one of aluminum, calcium and magnesium.

9. A process according to claims 7 or 8, wherein:

said steel items are immersed in said bath for approximately 15 minutes.

10. A process according to claims 7 or 8 wherein:

said bath is at a temperature of approximately 450° C.

11. An article made of a silicon-containing steel, formed to have a zinc-containing surface coating of a predetermined thickness independent of the silicon content of the steel and produced by hot-dipping the steel article in a bath containing:

1–5 wt of tin, 0.01–0.1 wt % of nickel, lead at a concentration up to saturation and 0–0.06 wt % of at least one of aluminum, calcium and magnesium, the rest being zinc of any quality going from remelted zinc scrap to SHG zinc.

12. The article made according to claim 11, wherein:

the bath contains 0–0.03 wt % of said at least one of aluminum, calcium and magnesium.

13. The article made according to claims 11 or 12, wherein:

said bath contains at least 0.03 wt % of nickel.

* * * * *